US005261315A

United States Patent [19]

Marinos

[11] Patent Number: 5,261,315

[45] Date of Patent: Nov. 16, 1993

[54] PRECISION CAPILLARY DISCHARGE SWITCH

[75] Inventor: Charalampos D. Marinos, Brooklynn Center, Minn.

[73] Assignee: FMC Corporation, Chicago, Ill.

[21] Appl. No.: 52,861

[22] Filed: Apr. 27, 1993

Related U.S. Application Data

[63] Continuation of Ser. No. 787,177, Nov. 4, 1991, abandoned.

[51] Int. Cl.[5] ..... F42B 3/14

[52] U.S. Cl. ..... 102/202.7; 89/8; 102/202.8; 102/472; 200/61.08; 315/76; 315/203; 328/251

[58] Field of Search ..... 89/8; 102/202.5, 202.7, 102/202.8, 472; 124/3; 200/61.08; 315/58, 71, 76, 203, 355; 328/249, 250, 251; 361/104, 129, 130

[56] References Cited

U.S. PATENT DOCUMENTS 1,302,229 4/1919 Schweitzer et al. ..... 361/130
1,359,971 11/1920 Dryden ..... 361/129
2,967,256 1/1961 Rees ..... 361/129
4,715,261 12/1987 Goldstein et al. ..... 89/8

FOREIGN PATENT DOCUMENTS 191322 8/1937 Switzerland ..... 361/130

*Primary Examiner*—Stephen C. Bentley
*Attorney, Agent, or Firm*—G. Wolde-Michael; R. C. Kamp; R. B. Megley

[57] ABSTRACT

The apparatus and method disclosed herein relates to a precision capillary discharge switch to deliver a predetermined power across a gap at the ends of electrodes enclosed in a containment envelop with a fluid media therein. A method of calibration is used to assign specific operating and arc triggering voltages based on a given gap dimension, ionization properties of the fluid or gas media and pressure within the containment envelope. The ends of the electrodes at the calibrated gap include tip geometry designed to reliably transfer power across the gap when the desired operating voltage range is reached.

18 Claims, 2 Drawing Sheets

PRECISION CAPILLARY DISCHARGE SWITCH

This application is a continuation of application Ser. No. 07/787,177, filed Nov. 4, 1991, now abandoned.

FIELD OF THE INVENTION

The present invention relates to an apparatus and method for a voltage switch and more particularly to a switch for transferring energy in a high voltage pulse network using a calibrated arc gap.

SUMMARY OF THE INVENTION

It is an object of the present invention to provide an apparatus and method for reliably delivering power in applications involving high voltage electrical networks.

Another object of the present invention is to provide an apparatus and method for a reliable but less cumbersome power transfer system by incorporating an arc gap in a capillary fuse system operating in a high voltage pulse network.

Yet another object of the present invention is to provide a reliable power switch by enabling a precise calibration of an arc gap dimension across electrodes in a containment envelope correlative to specific operating voltage ranges for specific fluid media and pressure within the containment envelope.

To achieve the above objects, there is provided in accordance with the present invention a capillary having a bore therethrough with first and second opposing ends. A high voltage anode terminal is disposed at the first open end of the capillary and a grounding cathode terminal is situated at the second open end. A first and a second fuse wire ends extending from an anode and a cathode terminal, respectively, are disposed in a containment envelope forming a gap therebetween. A power supply means is connected to the anode and cathode terminals.

Yet another aspect of the invention includes a capillary having a bore with first and second opposing open ends. A high voltage anode terminal is disposed along a longitudinal axis at the first open end of the capillary and a grounding cathode terminal is located at the second open end of the capillary. Fuse wires are connected to the anode and the cathode terminals. A containment envelope is disposed in the capillary wherein the fuse wire ends are enclosed forming a gap therebetween. A terminal from a high voltage low power triggering circuit means is also enclosed in the containment envelope. Further, a fluid media is confined within the containment envelope. A power supply means is also provided with connections to the anode and cathode terminals.

The present invention includes a method of calibrating an arc gap in a containment envelope to provide a precision discharge switch. The method comprises enclosing two electrodes having a gap at their ends in the containment envelope. The containment envelope is filled with a known fluid at a known pressure and the electrodes are connected to a power source whereby a current is caused to flow between the ends of the electrodes. Voltage is gradually increased to determine a breakdown voltage by noting an abrupt rise in current for a small increase in voltage. Further, the gap between the electrodes is varied to determine a corresponding breakdown voltage for each gap distance.

Furthermore, the present invention discloses a method of triggering an arc across a gap between electrodes disposed in a containment envelope. The method includes the steps of enclosing electrodes extending from an anode and a cathode terminal in the containment envelope and forming a gap between them. A terminal is also enclosed with the electrodes. Additionally, a fluid a confined in the containment envelope forming a media therein. By supplying power to the electrodes and connecting the terminal to power from a high voltage low power triggering circuit means, the fluid media in the containment envelope is ionized to create a triggering voltage for an arc across the gap.

DESCRIPTION OF THE PREFERRED EMBODIMENTS

The precision capillary discharge switch disclosed herein is designed to incorporate an arc gap in a cartridge capillary fuse such that the cartridge capillary becomes a switch for voltage discharge. Specifically, the disclosure relates to triggering an arc across a gap by either overvoltaging or using a third electrode and applying a voltage pulse as low as 3000 Volts. The present invention eliminates the need of cumbersome power switches and related hardware used in existing pulsed power system. Furthermore, the problem of how to increase the reliability of a pulse power switching system is also a subject of this invention. As will now be discussed, the present invention provides a reliable and precision capillary discharge switch by enabling the use of an arc switch in which the length of the arc gap and the environment in which the arc is contained are adaptively controlled to transfer a predetermined amount of electrical energy.

Figure 1A:
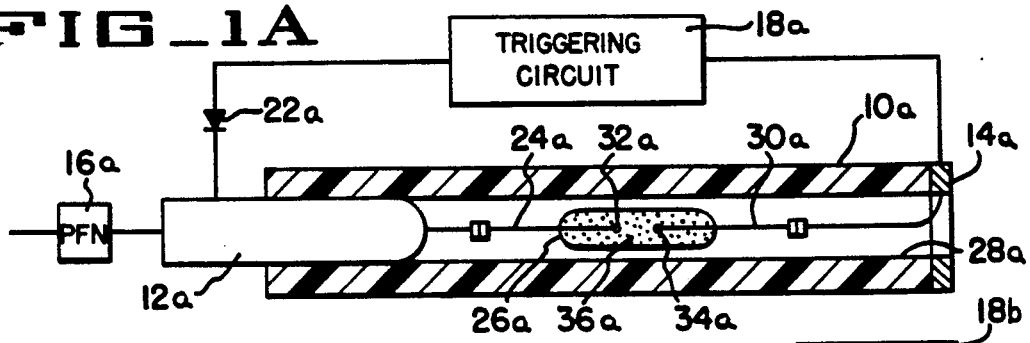
FIG. 1A is a central section of the present invention with a simplified block type depiction of the power supply units for arc triggering across electrodes.

A capillary 10*a* with opposite ends open is shown in FIG. 1A. The capillary 10*a* is fabricated from some non-conductive or dielectric material such as plastic. A high voltage anode terminal 12*a* is inserted at one of the open ends of capillary 10*a*. A grounding cathode 14*a* is attached at the other open end of the capillary 10*a*. A pulse forming network (PFN) 16*a* is connected to the anode terminal 12*a*. Further, the anode terminal 12*a* and the cathode terminal 14*a* are connected to a high voltage low power triggering circuit 18*a*. A diode stock 22*a* is placed between the anode terminal 12*a* and the high voltage low power triggering circuit 18*a* to prevent a reverse current flow. A fuse wire 24*a* is connected to one end of the anode terminal 12*a* and is inserted into a containment envelope 26*a*, which is located in the bore 28*a* of the capillary 10*a*. Similarly, a fuse wire 30*a* is connected to the cathode terminal 14*a* and is inserted into the containment envelope 26*a*. The fuse wires 24*a* and 30a extending from both the anode terminal 12a and the cathode terminal 14a, respectively, enter into the containment envelope 26a and terminate at separate opposite ends 32a and 34a whereby a gap 36a is formed.

Figure 2A:
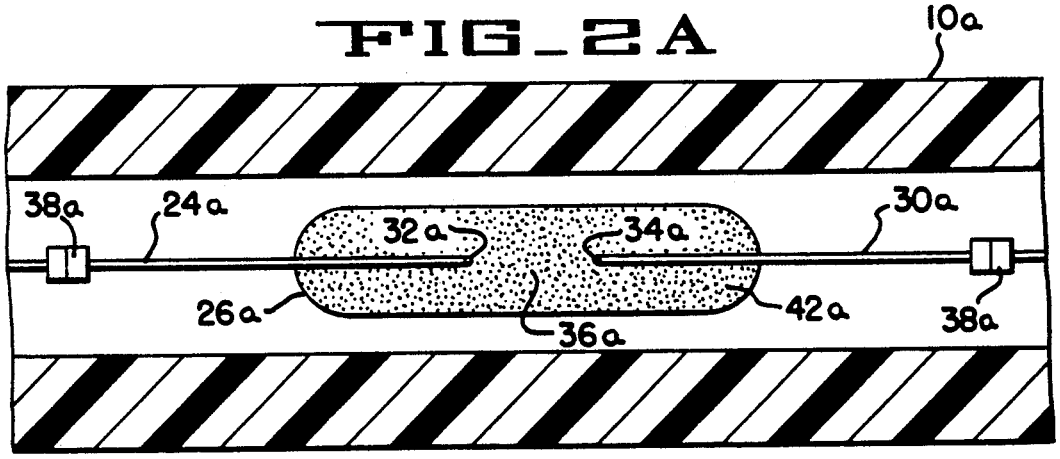
FIG. 2A is an enlarged central section of a portion of FIG. 1A.

Turning now to FIG. 2A, a detail view of the connections of the fuse wire means 24a and 30a and the containment envelope 26a is shown. A quick disconnect 38a is shown which enables an easier assembly of the fuse wires 24a and 30a connections to the anode 12a and cathode 14a terminals as well as to the containment envelope 26a. As will be discussed in more detail hereinafter, the length of the gap is predetermined using parameters similar to those shown on the graph of FIG. 3. Thus, the distance 36a between the fuse wire ends or the electrodes 32a and 34a is preset. Further, the containment envelope 26a is filled with the desired gas 42a at a predetermined pressure to provide a fluidic media therein. For a glass containment envelope 26a of 2–3 mm diameter, the gas pressure can be a few hundred psi. Since part of the gas 42a is ionized the operating voltage (Curve 2) is dependent upon the pressure and type of gas 42a enclosed in the containment envelope 26a.

Figure 1B:
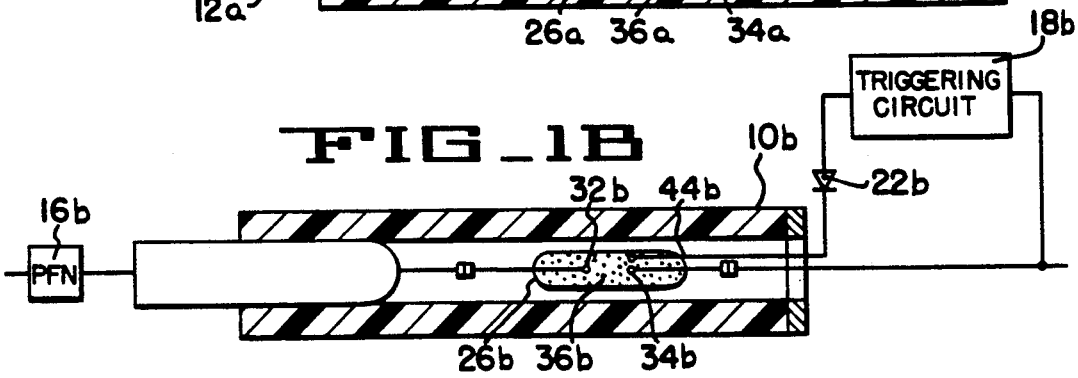
FIG. 1B is a central section of the present invention with a simplified block type depiction of the power supply units showing an alternate arrangement of arc triggering power supply arrangement.
Figure 2B:
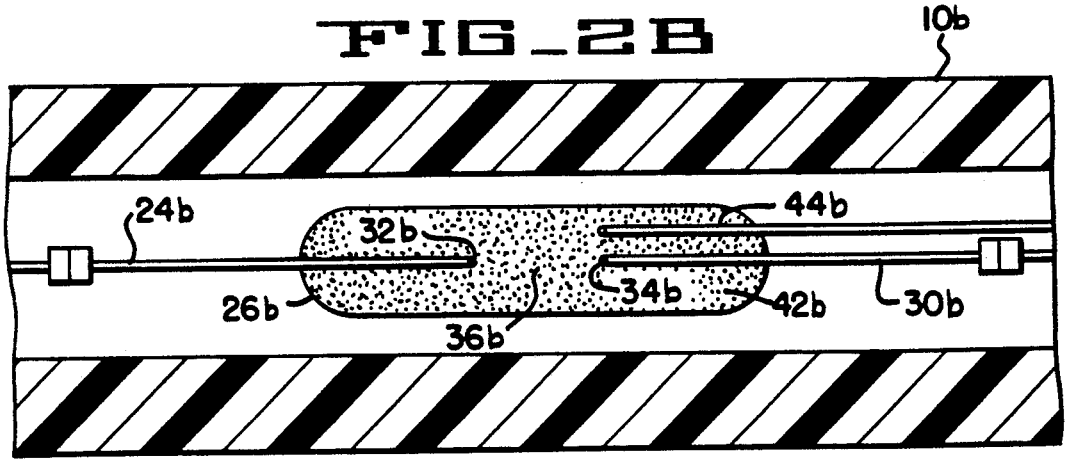
FIG. 2B is an enlarged central section of a portion of FIG. 1B.

Referring now to FIGS. 1B and 2B, another embodiment is shown where a terminal 44b from a high voltage low power triggering circuit 18b is enclosed in the containment envelope 26b. The terminal 44b extends near and is spatially separated from the electrodes 32b and 34b in the containment envelope 26b. The containment envelope 26b is filled with gas 42b forming the fluid media therein. The terminal 44b is used to ionize the gas 42b in order to provide a lower triggering voltage so that PFN 16b may trigger an arc across the gap 36b at a lower pulse voltage level.

Figure 3:
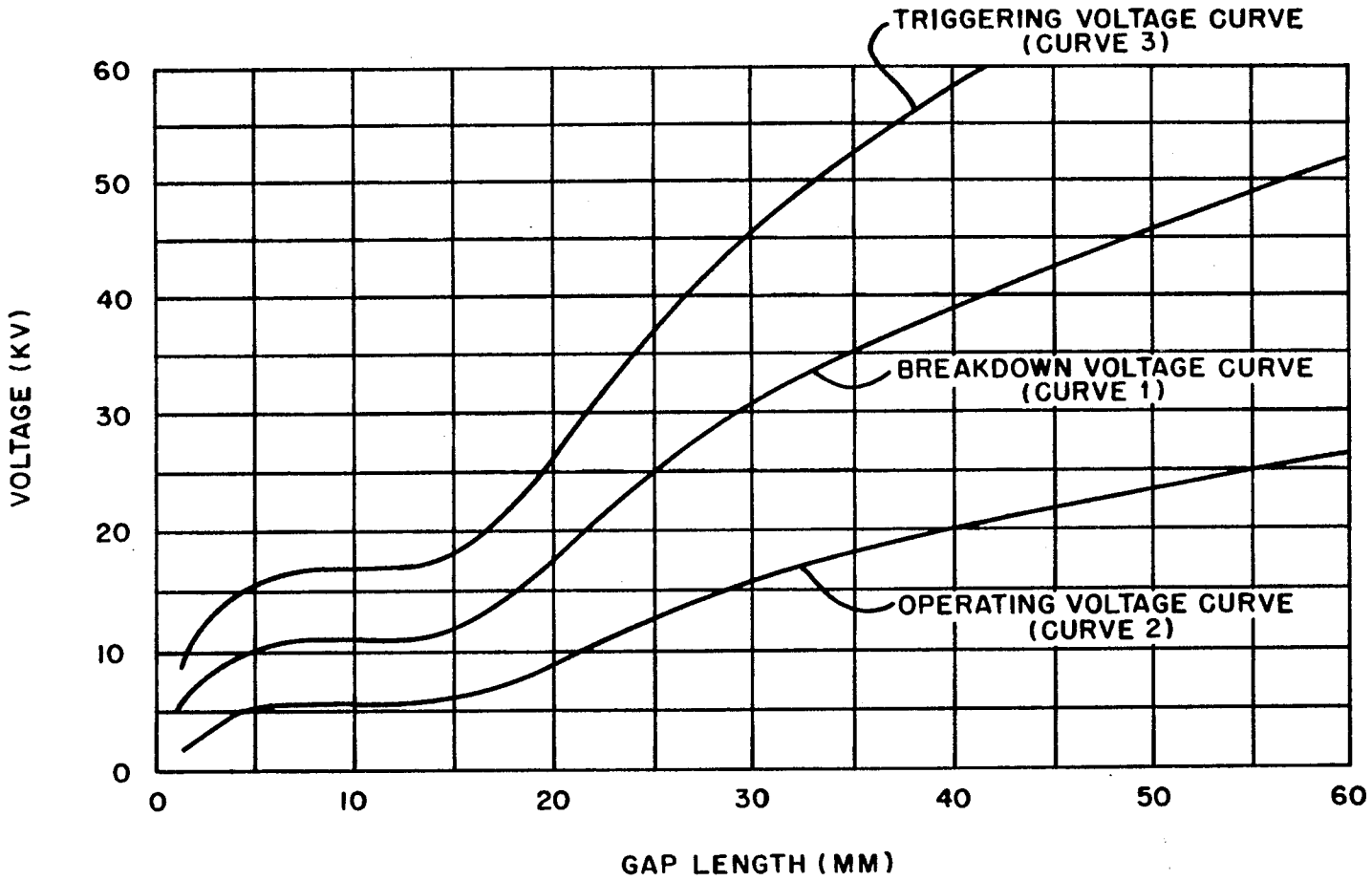
FIG. 3 is a graph depicting relations between Voltage and gap length. It shows gap length in millimeters (mm) versus the Breakdown Voltage curve (Curve 1), the Operating Voltage curve (Curve 2) and the Triggering Voltage curve (Curve 3) in Killo Volts (KV).

Referring now to FIG. 3, curve 1 represents a Breakdown Voltage between the electrodes 32a and 34a, as a function of the gap 36a between them. Curve 1 is plotted using experimental values based on electrodes 32a and 34a having spherical tip geometry with 2 mm diameter. The gap 36a was varied and the Breakdown Voltage recorded by noting an abrupt rise in current for a small increase in voltage. Atmospheric air was used as the fluidic media in the containment envelope 26a at ambient pressure and temperature. The humidity of the air was not controlled. After Curve 1 is generated, the Operating Voltage Curve (Curve 2) is derived by multiplying Curve 1 by a factor. The factor is dependent upon empirical values and safety factors tailored to the application. Similarly, the Triggering Voltage curve (Curve 3) is obtained by multiplying Curve 1 by a factor. The factor is based on both empirical and application considerations to guarantee a reliable triggering of an arc across the gap 36a. This method of calibration is used to set operating and triggering voltages for a given gap in a known gas media under a specified containment envelope 26a pressure.

One of the most significant aspects of this invention is the incorporation of the precision switch into an electrothermal chemical (ETC) gun cartridge to transfer electric power into the gun, thus eliminating the use of an external PFN switch and associated hardware. In its best mode the system operates as disclosed herein below.

Referring to FIGS. 1A and 1B, after the length of the gap 36a is determined, based on the calibration method described hereinbefore, the electrodes 32a and 34a are inserted into the containment envelope 26a and the gap 36a is set therebetween. Further, the containment envelope 26a is filled with the desired gas 42a at a predetermined pressure. Thereafter, the containment envelope 26a is sealed. Generally, the containment envelope 26a is made of glass and the method of sealing used will be consistent with conventional glass sealing and fusion of glass to metal techniques.

A predetermined operating voltage pulse is transmitted via the PFN 16a into the anode terminal 12a. This voltage pulse is transferred to the fuse wire 24a and eventually resides in the electrode 32a within the containment envelope 26a. Further, a high voltage low power triggering circuit means 18a is connected to the anode 12a and cathode 14a terminals. The fuse wire 30a is also connected to the cathode terminal 14a and extends into the containment envelope 26a forming the electrode 34a therein. Accordingly, when the high voltage low power triggering circuit 18a is actuated, sufficient voltage differential is created between the ends of the eclectrodes 32a and 34a that an arc will jump to bridge the gap 36a thus allowing the flow of current across to the cathode terminal 14a. Particularly, by varying the gap distance 36a between the electrodes 32a and 34a different voltage levels may be used to trigger current transfer across the gap 36a. More particularly, by supplying a predetermined voltage via the PFN 16a which is equivalent to the operating voltage (See FIG. 3 Curve 2) and by supplying an additional voltage which is the triggering voltage (See FIG. 3 Curve 3) via the high voltage low power triggering circuit 18a, just enough voltage is created to cause an arc to bridge the pre-set gap 36a. It should be noted that the gas 42a and the pressure remain constant such that only the gap 36a is varied. In the alternate, the type of gas 42a and or the pressure may be varied to calibrate the gap 36a and determine the corresponding breakdown, operating and triggering voltage ranges. Moreover, depending on the application, all the parameters or a combination thereof may be varied. Consequently, the disclosed embodiment operates as a precision preadjusted switch which enables a reliable and controllable transfer of power at varying voltage levels.

One of the unique aspects of the disclosed invention is the use of substantially spherical geometric shapes at the ends of the electrodes 32a and 34a. The substantially spherical tip geometrics promote the formation of an arc at a prespecified voltage and gap 36a for a given gas 42a at a specified pressure within the containment envelope 26a. It is well known in the art that sharp electrode edges and tips produce very high electric fields which may cause a premature and uncontrolled pretriggering of arc across a gap such as 36a. The sharper the edge the higher the probability of a pretrigger. The spherical tip geometries employed in this invention, on the other hand, make the precision discharge switch a more reliable triggering device. Spherical geometry tips require relatively high and more specific voltages to trigger and yield consistent and repeatable triggering voltage ranges under the same operating conditions.

If the triggering voltage would be too high and the insulation needed to operate in such a high voltage condition is undesirable, a circuit shown in FIG. 1B is used. As discussed hereinbefore, a terminal 44b is inserted into the containment envelope 26b to provide a terminal or third electrode within the containment envelope 26b. This arrangement enables triggering of an arc across a given gap 36b at a lower triggering voltage level. The terminal 44b acts as a third electrode to enhance the ionization of the gas 42b and increases the tendency of the arc to jump the gap 36b at a comparatively lower triggering voltage level.

The precision capillary discharge switch disclosed herein is a disposable switch. Thus, for example, when an ETC cartridge is fired a new precision discharge switch is used with the new cartridge. In contrast, existing switches are used to fire several shots before they are overhauled or replaced. Due to thermal and dynamic erosion, all known switches degrade in performance and sometimes fail to fire upon command. Compared to these conventional switches, the precision capillary discharge switch is very reliable and provides ease of operation and increased rate of fire. The precision capillary switch is manufactured to a predetermined performance specification and is used as a disposable unit with each round of a gun such as ETC or Combustion Augmented Plasma (CAPtm) gun system.

Specifically, when used in conjunction with an ETC or CAP(tm) gun system, the invention disclosed herein can be used as a plasma capillary switch. U.S. Pat. No. 4,895,062, Chryssomallis et al contains a disclosure of a plasma injector which includes a plasma capillary. The present invention is distinct from earlier plasma capillaries in as much as the arc or plasma generation and transfer is controlled based on the length of the gap 36a, the pressure and type of gas 42a and the tip geometry at the ends of the electrodes 32a and 34a. To be used as a plasma arc switch in a CAP (tm) gun system, a high-current, high voltage arc is established across the gap 36a between the electrodes 32a and 34a. The plasma thus created is sustained by ablating the containment envelope 26a/26b and the dielectric capillary 10a/10b. In this capacity, the disclosed embodiments can be used as a precision capillary discharge switch as well as a disposable plasma capillary.

Accordingly, the precision discharge switch utilizes a calibrated gap set between electrodes having substantially spherical tip geometries to generate an arc across the calibrated gap disposed in a containment envelope comprising of a gas media at a specified pressure. The device is calibrated and manufactured to operate under specific operating voltage and triggering voltage and is disposable after first use. The device may be integrated with a cartridge or may be independently set in a power supply system. The precision capillary discharge switch disclosed herein, therefore, provides a precise capillary discharge switch that can be manufactured to be tailor made to specific operating conditions and is less cumbersome and more reliable than presently available power switches used in high voltage pulse network systems.

Although the best mode contemplated for carrying out the present invention has been herein shown and described, it will be apparent that modifications and variations may be made without departing from what is regarded to be the subject matter of the invention.

What is claimed is:

1. A precision discharge switch comprising:

an ablatable dielectric capillary having a bore therethrough with first and second open ends;

a high voltage anode terminal disposed at said first end partially extending into said bore to thereby form a closed end;

a grounding cathode terminal disposed at said second open end;

an ablatable containment envelope concentrically disposed in said ablatable dielectric capillary;

a first metallic fuse wire connected to the anode terminal and fusion welded with said ablatable containment envelope and having an end extending therein;

a second metallic fuse wire connected to the cathode terminal and fusion welded with said ablatable containment envelope and having an end extending therein;

a high voltage low power triggering circuit connected to said anode and said cathode terminals;

a diode stock placed between said anode terminal and said high voltage low power triggering circuit; and a power supply means connected to said anode and said cathode terminals.

2. The precision discharge switch of claim 1 wherein said ablatable dielectric capillary forms a sleeve around the anode terminal at said first open end and further concentrically abuts against the cathode terminal at said second open end.

3. The precision discharge switch of claim 1 wherein said ablatable containment envelope includes a fluidic media under positive pressure therein.

4. The precision discharge switch of claim 1 wherein said first and second metallic fuse wires extending into said ablatable containment envelope further comprise an arrangement in which the ends are opposite each other and separated by a gap therebetween.

5. A disposable precision discharge switch and a plasma capillary comprising:

an ablatable dielectric capillary having a bore therethrough with first and second open ends;

a high voltage anode terminal disposed at said first end partially extending into said bore to thereby form a closed end;

a grounding cathode terminal disposed at said second end;

an ablatable containment envelope concentrically disposed in said ablatable dielectric capillary;

a first metallic fuse wire connected to said anode terminal and fusion welded with said ablatable containment envelope and having an end extending therein;

a second metallic fuse wire connected to the cathode terminal and fusion welded with said ablatable containment envelope and having an end extending therein;

a high voltage low power triggering circuit connected to said anode and said cathode terminals;

a diode stock placed between said anode terminal and said high voltage low power triggering circuit; and a power supply means connected to said anode and said cathode terminals.

6. The precision discharge switch of claim 4 wherein said ablatable dielectric capillary forms a sleeve around the anode terminal at said first open end and further concentrically abuts against the cathode terminal at said second open end.

7. The precision discharge switch of claim 4 wherein said ablatable containment envelope includes a fluidic media under positive pressure therein.

8. The precision discharge switch of claim 4 wherein said first and second metallic fuse wires extending into said ablatable containment envelope further comprise an arrangement in which the ends are opposite each other and separated by a gap therebetween.

9. A precision discharge switch comprising:

an ablatable dielectric capillary having a bore therethrough with first and second open ends;

a high voltage anode terminal disposed at said first end partially extending into said bore to thereby form a closed end;

a grounding cathode terminal disposed at said second open end;

an ablatable containment envelope concentrically disposed in said ablatable dielectric capillary;

a first metallic fuse wire connected to the anode terminal and fusion welded with said ablatable containment envelope and having an end extending therein;

a second metallic fuse wire connected to the cathode terminal and fusion welded with said ablatable containment envelope and having an end extending therein;

a third metallic electrode coupled to a high voltage low power triggering circuit fusion welded to said ablatable containment envelope and having an end extending therein;

said high voltage low power triggering circuit connected to said second metallic fuse wire;

a diode stock placed between said third electrode and said high voltage low power triggering circuit; and a power supply means connected to said anode and said cathode terminals.

10. The precision discharge switch of claim 9 wherein said ablatable dielectric capillary forms a sleeve around the anode terminal at said first open end and further concentrically abuts against the cathode terminal at said second open end.

11. The precision discharge switch of claim 9 further comprising an arrangement in which the end of the first metallic fuse wire is opposite the ends of the second metallic fuse wire and the third metallic electrode and separated by a gap therebetween.

12. The precision discharge switch of claim 9 wherein said ablatable containment envelope includes a fluidic media under positive pressure therein.

13. The precision discharge switch of claim 9 wherein said second metallic fuse wire and said third metallic electrode extending into said ablatable containment envelope are oriented parallel to each other with a gap therebetween.

14. A disposable precision discharge switch and a plasma capillary comprising:

an ablatable dielectric capillary having a bore therethrough with first and second open ends;

a high voltage anode terminal disposed at said first end partially extending into said bore to thereby form a closed end;

a grounding cathode terminal disposed at said second end;

an ablatable containment envelope concentrically disposed in said ablatable dielectric capillary;

a first metallic fuse wire connected to the anode terminal and fusion welded with said ablatable containment envelope and having an end extending therein;

a second metallic fuse wire connected to the cathode terminal and fusion welded with said ablatable containment envelope and having an end extending therein;

a third metallic electrode coupled to a high voltage low power triggering circuit fusion welded with said ablatable containment envelope and having an end extending therein;

said high voltage low triggering circuit connected to said second metallic fuse wire;

a diode stock placed between said third electrode and said high voltage low power triggering circuit; and a power supply means connected to said anode and said cathode terminals.

15. The precision discharge switch of claim 14 wherein said ablatable dielectric capillary forms a sleeve around the anode terminal at said first open end and further concentrically abuts against the cathode terminal at said second open end.

16. The precision discharge switch of claim 14 wherein said ablatable containment envelope includes a fluidic media under positive pressure therein.

17. The precision discharge switch of claim 14 further comprising an arrangement in which the end of the first metallic fuse wire is opposite the ends of the second metallic fuse wire and the third metallic electrode and separated by a gap therebetween.

18. The precision discharge switch of claim 14 wherein said second metallic fuse wire and said third metallic electrode extending into said ablatable containment envelope are oriented parallel to each other with a gap therebetween.

* * * * *